US011920284B2

(12) United States Patent
Weng et al.

(10) Patent No.: US 11,920,284 B2
(45) Date of Patent: Mar. 5, 2024

(54) DOOR ASSEMBLY OF LAUNDRY TREATMENT DEVICE AND LAUNDRY TREATMENT DEVICE

(71) Applicants: QINGDAO HAIER DRUM WASHING MACHINE CO., LTD., Shandong (CN); Haier Smart Home Co., Ltd., Shandong (CN)

(72) Inventors: Zongyuan Weng, Qingdao (CN); Kai Liu, Qingdao (CN); Xuekai Guo, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 902 days.

(21) Appl. No.: 16/962,039

(22) PCT Filed: Dec. 20, 2018

(86) PCT No.: PCT/CN2018/122415

§ 371 (c)(1),
(2) Date: Jul. 14, 2020

(87) PCT Pub. No.: WO2019/137177

PCT Pub. Date: Jul. 18, 2019

(65) Prior Publication Data

US 2020/0399818 A1 Dec. 24, 2020

(30) Foreign Application Priority Data

Jan. 15, 2018 (CN) ..... 201810035327.0

(51) Int. Cl.
*D06F 39/14* (2006.01)
*D06F 21/04* (2006.01)

(52) U.S. Cl.
CPC ..... *D06F 39/14* (2013.01); *D06F 21/04* (2013.01)

(58) Field of Classification Search
CPC ..... D06F 39/14; D06F 21/04
See application file for complete search history.

(56) References Cited

U.S. PATENT DOCUMENTS

2012/0049703 A1* 3/2012 Fang ..... D06F 39/14 49/70
2018/0087206 A1* 3/2018 Jiang ..... E05D 7/04

FOREIGN PATENT DOCUMENTS

CN 202898808 U 4/2013
CN 105177911 A 12/2015
(Continued)

OTHER PUBLICATIONS

International Search Report dated Mar. 19, 2019 in corresponding International application No. PCT/CN2018/122415; 6 pages.

*Primary Examiner* — Joseph L. Perrin
(74) *Attorney, Agent, or Firm* — Maier & Maier, PLLC

(57) ABSTRACT

A door assembly of a laundry treatment device and a laundry treatment device. The door assembly includes an outer frame, an inner frame and an observation window provided between the outer frame and the inner frame, a mounting assembly being provided between the outer frame and the inner frame, the observation window being rotatably sandwiched between the outer frame and the inner frame by means of the mounting assembly. With this arrangement, the observation window can be rotated relative to the inner frame and the outer frame without deviating from the space between the inner frame and the outer frame, such that in the process of rotating the entire door assembly 180° to switch the door opening direction, the mounting requirement of the observation window can be satisfied only by separately
(Continued)

rotating the observation window 180°, rotating same and then mounting same back to the door assembly.

6 Claims, 5 Drawing Sheets

(56) References Cited

FOREIGN PATENT DOCUMENTS

| | | | | | |
|---|---|---|---|---|---|
| CN | 206127678 | U | 4/2017 | | |
| CN | 106906622 | A | 6/2017 | | |
| EP | 2843107 | A1 * | 3/2015 | ..... | D06F 39/14 |
| EP | 3034677 | A1 | 6/2016 | | |
| KR | 20050022092 | A | 3/2005 | | |
| WO | WO-03004754 | A1 * | 1/2003 | ..... | D06F 37/28 |
| WO | WO-2018006781 | A1 * | 1/2018 | ..... | D06F 37/28 |

* cited by examiner

DOOR ASSEMBLY OF LAUNDRY TREATMENT DEVICE AND LAUNDRY TREATMENT DEVICE

FIELD

The present disclosure belongs to the technical field of laundry treatment device, and specifically provides a door assembly of a laundry treatment device, and a laundry treatment device.

BACKGROUND

A front-loading drum washing machine includes a machine body and a machine door disposed on a front side of the machine body. Before the drum washing machine performs a washing operation, the user needs to open the door on the front side of the drum washing machine to put laundry in. Specifically, the door includes an observation window with a raised structure formed on an inner side, so only after a door opening angle of the machine door reaches a certain degree (such as at least 140°) can the machine door be fully opened to meet the user's need for picking up and placing laundry. However, since there may be obstacles near the drum washing machine that affect the opening of the machine door, such as a wall of a room or other household appliances placed around the drum washing machine, a placement environment of the drum washing machine is restricted.

At present, the drum washing machine is typically provided with a machine door, for which a door opening direction can be switched. When there is an obstacle on a side of the drum washing machine, which affects a normal opening of the machine door, the user can detach the machine door from the machine body, rotate it by 180° and then reinstall it on the machine body so that the machine door can be switched from being opened by rotating in a direction approaching the obstacle to being opened by rotating in a direction away from the obstacle. As such, a normal use of the drum washing machine is ensured without moving the drum washing machine. However, the disadvantage of the above method is that some of the observation windows are provided with the above raised structure in an asymmetric manner After the machine door is rotated by 180°, the observation window is inverted due to the rotation, so that the position of the raised structure of the observation window is changed from being away from a spraying device in the drum washing machine to being close to the spraying device, thereby affecting a spraying effect of the drum washing machine. In this case, in order to enable the raised structure of the observation window to be located away from the spraying structure, the user also needs to detach the observation window from the machine door and rotate it by 180° before assembling it onto the machine door, which takes a lot of time for assembly and makes the step of switching the opening direction of the machine door cumbersome.

Accordingly, there is a need in the art for a new door assembly of a laundry treatment device as well as a laundry treatment device to solve the above problems.

SUMMARY

In order to solve the above problems in the related art, that is, to solve the problems of cumbersome assembling steps and long installation time when the door opening direction is switched for the machine doors of the existing drum washing machines, the present disclosure provides a door assembly of a laundry treatment device, wherein the door assembly includes an outer frame, an inner frame, and an observation window disposed between the outer frame and the inner frame, and wherein an installation assembly is disposed between the outer frame and the inner frame, and the installation assembly is configured to enable the observation window to be rotatably sandwiched between the outer frame and the inner frame.

In a preferred technical solution of the above door assembly of the laundry treatment device, the installation assembly includes at least one fixing member disposed on an inner edge of the outer frame or an inner edge of the inner frame, wherein the fixing member is formed with an installation groove, and an edge of the observation window is rotatably accommodated in the installation groove.

In a preferred technical solution of the above door assembly of the laundry treatment device, the installation assembly further includes a guide assembly disposed in the installation groove, and the observation window is rotated in the installation groove by means of the guide assembly.

In a preferred technical solution of the above door assembly of the laundry treatment device, the guide assembly includes: rolling members; limiting grooves disposed on an inner side of a groove wall of the installation groove, the rolling members being rotatably accommodated in the limiting grooves; and annular guide grooves disposed on the edge of the observation window, the rolling members also being capable of rolling in the annular guide grooves.

In a preferred technical solution of the above door assembly of the laundry treatment device, the rolling members are balls, and the limiting grooves are arc-shaped concave grooves disposed on the inner side of the groove wall.

In a preferred technical solution of the above door assembly of the laundry treatment device, an inner side and an outer side of the edge of the observation window are respectively provided with the annular guide groove, the groove walls on both sides of the installation groove are respectively provided with the arc-shaped concave groove, and the ball is embedded between the inner side of the observation window and the groove wall on the corresponding side as well as between the outer side of the observation window and the groove wall on the corresponding side.

In a preferred technical solution of the above door assembly of the laundry treatment device, a ring-shaped reinforcement structure is fixed to the inner frame, and the fixing member is disposed on the reinforcement structure.

In a preferred technical solution of the above door assembly of the laundry treatment device, a locking assembly is further disposed between the outer frame and the inner frame, and the locking assembly includes: a limiting post disposed in a radial direction of the observation window; a guide groove disposed in the reinforcement member; and a capture hole disposed in the observation window, wherein one end of the limiting post is fixed into the guide groove in an elastic connection manner, and the other end of the limiting post is inserted into or retracted from the capture hole in a retractable manner.

In a preferred technical solution of the above door assembly of the laundry treatment device, the limiting post is further provided with a protruding end, the reinforcement structure is provided with a slide groove, and the protruding end is capable of protruding into the slide groove and sliding along the slide groove.

A laundry treatment device is further provided, which includes any above described door assembly.

Those skilled in the art can understand that in the technical solutions of the present disclosure, the door assembly of the laundry treatment device of the present disclosure includes an outer frame, an inner frame, and an observation window disposed between the outer frame and the inner frame, and an installation assembly is disposed between the outer frame and the inner frame, wherein the observation window can be rotatably sandwiched between the outer frame and the inner frame through the installation assembly; that is, the observation window is capable of rotating relative to the inner frame and the outer frame without deviating from the space between the inner frame and the outer frame. Taking the machine door of the drum washing machine as an example, when the machine door is detached, rotated by 180° and then reinstalled onto the drum washing machine to switch the door opening direction, even if the observation window of the machine door has an asymmetric raised structure, there is no need for the user to detach the observation window from the machine door and adjust an installation orientation of the observation window on the machine door. It is only required to directly rotate the observation window assembled between the outer frame and the inner frame so that the raised structure can be adjusted to a position far away from the spraying position of the drum washing machine. In the process of switching the door opening direction of the machine door, the steps of detaching and reinstalling the observation window are omitted, and the operation time when the user switches the door opening direction of the machine door is shortened.

BRIEF DESCRIPTION OF THE DRAWINGS

Preferred embodiments of the present disclosure will be described below with reference to the drawings and in conjunction with an example in which the laundry treatment device is a washing machine. In the drawings.

DETAILED DESCRIPTION

Figure 1:
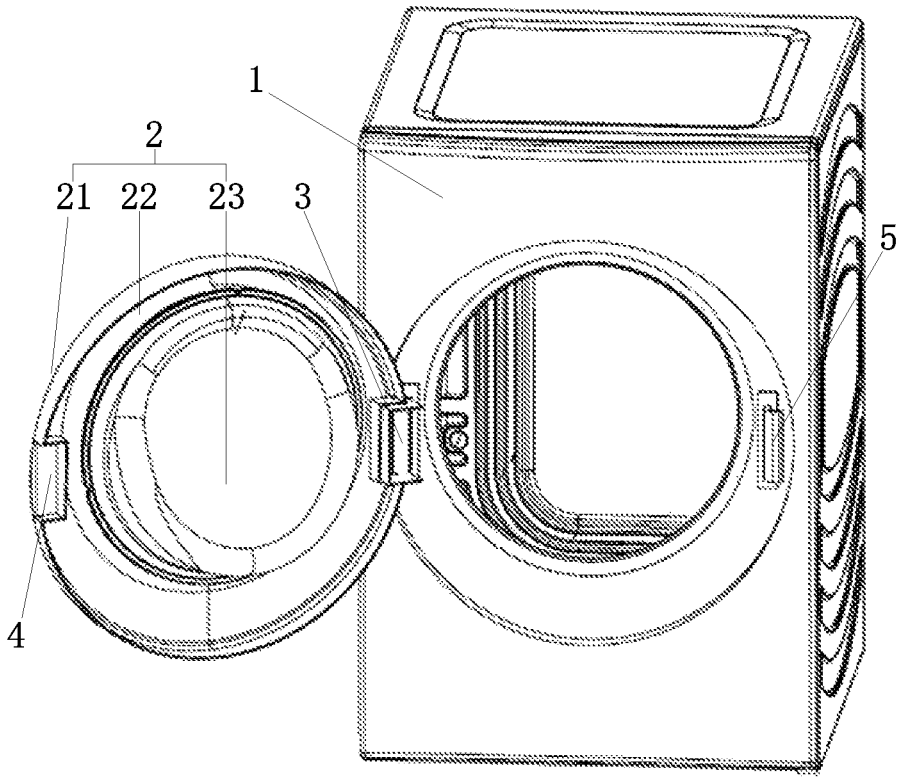
FIG. 1 is a schematic assembly view of a door assembly of a drum washing machine of the present disclosure.

First, it should be understood by those skilled in the art that these embodiments are only used to explain the technical principles of the present disclosure, and are not intended to limit the scope of protection of the present disclosure. Those skilled in the art may make an adjustment to the present disclosure as required so as to be adapted to specific application occasions. For example, although the door assembly of the present disclosure is described in conjunction with a drum washing machine, it is not limiting, and it is obvious that in addition to the drum washing machine, the door assembly of the present disclosure is also applicable to other laundry treatment devices with an observation window having a similar need for adjusting installation orientation.

It should be noted that in the description of the present disclosure, directional or positional relationships indicated by terms such as "left", "right", "inner" and "outer" are based on the directions or positional relationships shown in the drawings. They are merely used for the convenience of description, and do not indicate or imply that the device or element involved must have a specific orientation, or be configured or operated in a specific orientation, and therefore they should not be construed as limiting the present disclosure.

In addition, it should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Figure 2:
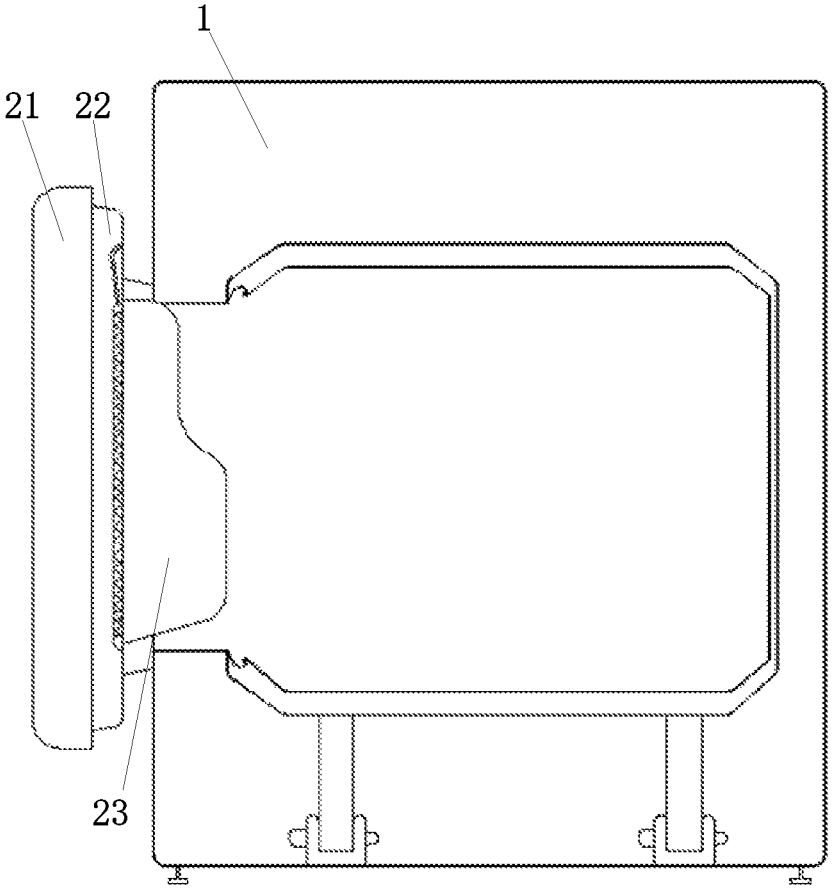
FIG. 2 is a schematic view showing an overall structure of a door assembly of a drum washing machine of the present disclosure.
Figure 3:
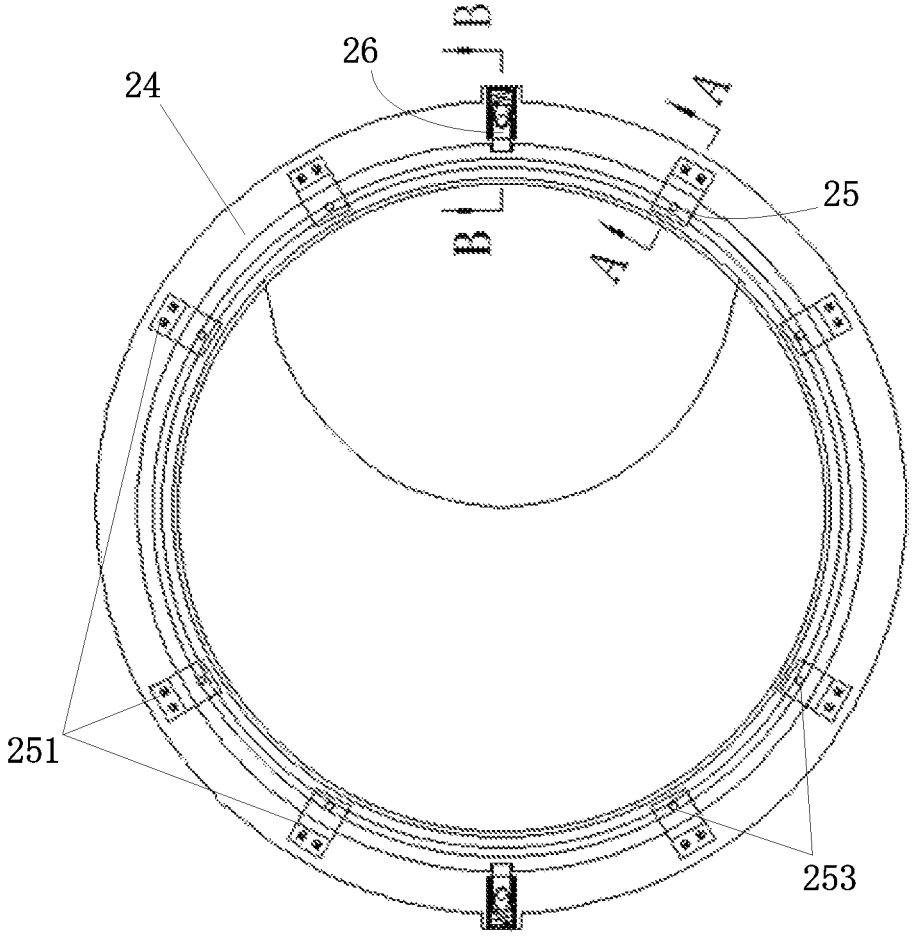
FIG. 3 is a schematic view showing an internal structure of a door assembly of a drum washing machine of the present disclosure, in which an installation assembly of the door assembly is illustrated.

Reference is first made to FIGS. 1, 2 and 3, wherein FIG. 1 is a schematic assembly view of a door assembly of a drum washing machine of the present disclosure, FIG. 2 is a schematic view showing an overall structure of a door assembly of a drum washing machine of the present disclosure, and FIG. 3 is a schematic view showing an internal structure of a door assembly of a drum washing machine of the present disclosure, in which an installation assembly of the door assembly is illustrated. As shown in FIGS. 1, 2 and 3, the drum washing machine includes a machine body 1 and a door assembly 2 pivotally connected to a front side of the machine body 1. According to the orientation of FIG. 1, a left side of the door assembly 2 is pivotally connected to the machine body 1 via a hinge 3, a door hook 4 is installed on a right side of the door assembly 2, and the machine body 1 is correspondingly provided with a door lock 5 that cooperates with the door hook 4. When the door assembly 2 is in a closed state, the door assembly 2 is locked to the machine body 1 through the cooperation of the door hook 4 and the door lock 5. In this case, a door opening direction of the door assembly 2 is as follows: taking a pivot axis of the hinge 3 as a rotation axis, the door assembly 2 is rotated around the rotation axis in a direction away from the door lock 5 (that is, the door assembly 2 in FIG. 1 is rotated from right to left in a clockwise direction), and the above-mentioned rotating direction is the initial door opening direction of the door assembly 2.

The door assembly 2 specifically includes a ring-shaped outer frame 21, a ring-shaped inner frame 22, and a disc-shaped observation window 23 disposed between the outer frame 21 and the inner frame 22. A ring-shaped reinforcement structure 24 is disposed on an inner edge of the inner frame 22, and an installation assembly 25 is also disposed between the outer frame 21 and the inner frame 22. The reinforcement structure 24 serves to enhance the strength of the inner frame 22, and the installation assembly 25 is disposed between the outer frame 21 and the inner frame 22 by being fixed to the reinforcement structure 24. Moreover, the installation assembly 25 is configured to enable the observation window 23 to be rotatably sandwiched between the outer frame 21 and the inner frame 22. In other words, the observation window 23 can rotate relative to the inner frame 22 and the outer frame 21 when it is installed between the inner frame 22 and the outer frame 21 through the installation assembly 25

When the door opening direction of the door assembly 2 is the initial door opening direction, the observation window 23 gradually protrudes inward from top to bottom, that is, the largest raised portion of the observation window 23 is located on a lower side of the door assembly 2. When the door assembly 2 is detached from the machine body 1 and rotated by 180° as a whole, the right side of the door assembly 2 changes from the door hook 4 to the hinge 3. After the fixed positions of the door lock 5 and the hinge 3 on the machine body 1 are interchanged, the rotated door assembly 2 is reinstalled to the machine body 1. At this point, the right side of the door assembly 2 is pivotally connected to the machine body 1, the door opening direction of the door assembly 2 is opposite to its initial door opening direction, and the largest raised portion of the observation window 23 is located on the upper side of the door assembly 2. In order to avoid that the displacement of the largest raised portion of the observation window 23 affects a spraying effect of the drum washing machine, finally the observation window 23 between the outer frame 21 and the inner frame 22 is separately rotated by 180° again, so that the largest raised portion of the observation window 23 moves back to the lower side of the door assembly 2 to meet the spraying requirements of the drum washing machine. Till now, the steps of switching the door opening direction of the door assembly 2 are all completed.

With the arrangement of the installation assembly 25, the installation orientation of the observation window 23 on the door assembly 2 can be adjusted without detaching the observation window 23 from the space between the outer window 21 and the inner frame 22, thereby saving the disassembly and assembly time of the door assembly 2 and simplifying the operation process when the user switches the door opening direction of the door assembly 2.

It should be noted that in the case where the strengths of the outer frame 21 and the inner frame 22 are sufficiently large, in addition to disposing the reinforcement structure 24 on the inner edge of the inner frame 22, the reinforcement structure 24 may also be disposed on an inner edge of the outer frame 21. Alternatively, the reinforcement structure 24 may be directly omitted, and the installation assembly 25 may be directly disposed on an inner side of the outer frame 21 or an outer side of the inner frame 22. That is, whether the reinforcement structure 24 needs to be disposed and the specific position of disposing the reinforcement structure 24 or the installation assembly 25 may be determined according to the actual strengths of the outer frame 21 and the inner frame 22.

Figure 4:
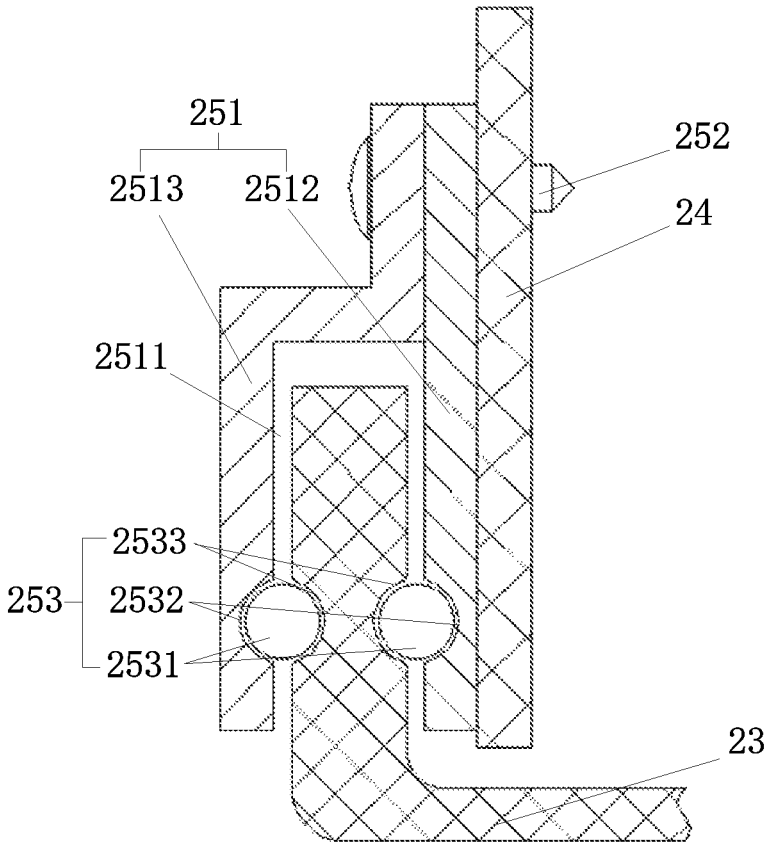
FIG. 4 is a cross-sectional view taken along line A-A in FIG. 3.
Figure 5:
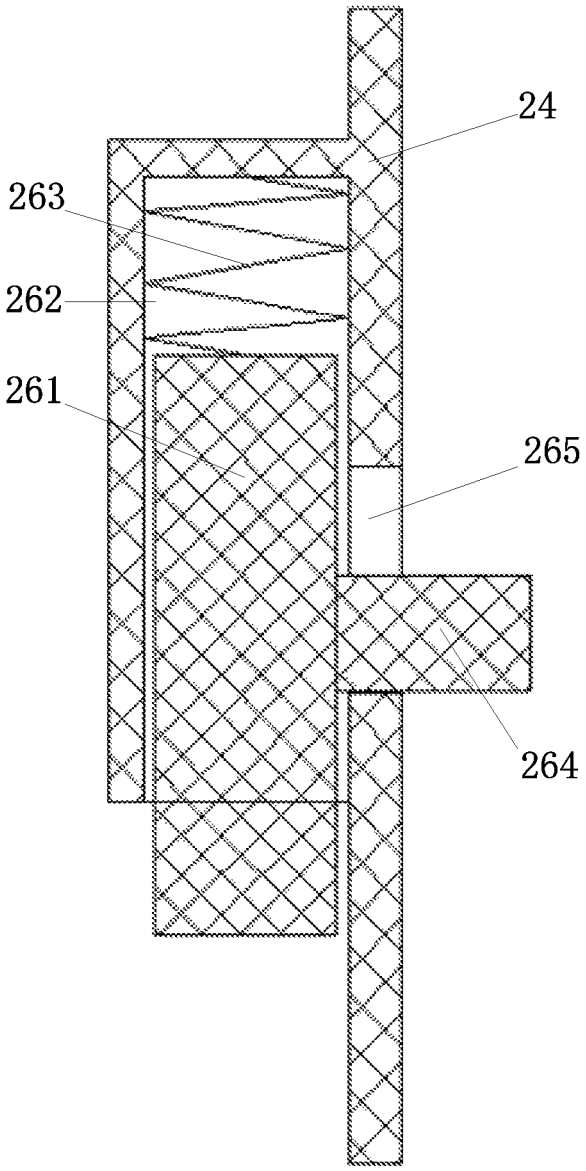
FIG. 5 is a cross-sectional view taken along line B-B in FIG. 3.

Next, reference is made to FIG. 4 and continued reference is made to FIG. 3, wherein FIG. 4 is a cross-sectional view taken along direction A-A in FIG. 3. As shown in FIGS. 3 and 4, as a preferred embodiment, the inner side of the reinforcement structure 24 is fixed to the inner edge of the inner frame 22, and the installation assembly 25 includes a plurality of fixing members 251 evenly distributed in a radial direction of the observation window 23 and fixed to an outside ring surface of the reinforcement structure 24. Moreover, each fixing member 251 is provided with an installation groove 2511, and opening directions of the installation grooves 2511 each face the edge of the observation window 23, so that the edge of the observation window 23 is rotatably accommodated in the installation grooves 2511. Specifically, according to the orientation of FIG. 4, the fixing member 251 includes a sheet-like first portion 2512 and a Z-shaped sheet-like second portion 2513 fixed to an outer side of the first portion 2512. An inner side of the first portion 2512 is fixed to the reinforcement structure 24, and an inner side of an upper end of the Z-shaped sheet-like second portion 2513 is fixed to the first portion 2512, so that the installation groove 2511 is formed between a lower end of the second portion 2513 and the first portion 2512, and the installation groove 2511 can be formed on the fixing member 251 in the form of a U-shaped groove. Of course, in order to insert the observation window 23 into the installation grooves 2511 or remove it from the installation grooves 2511, the first portion 2512 and the second portion 2513 are detachably connected. For example, a fastener such as a screw 252 passes through the second portion 2513 and the first portion 2512 in sequence and is threaded to the reinforcement structure 24, thereby fixing the first portion 2512 and the second portion 2513 of the fixing member 251.

With continued reference to FIGS. 3 and 4, in order to prevent the observation window 23 from being worn due to friction between the inner frame 22 and the outer frame 21 during the rotation, and to prevent the observation window 23 from jumping in the radial direction of the outer frame 21 or the inner frame 22, preferably, the installation assembly 25 further includes guide assemblies 253 disposed in the installation grooves 2511, and the observation window 23 rotates in the installation grooves 2511 through the guide assemblies 253. Specifically, the guide assembly 253 includes rolling members 2531 in the form of a ball, limiting grooves 2532 disposed on an inner side of a groove wall of the installation groove 2511, and annular guide grooves 2533 disposed on the edge of the observation window 23. According to the orientation of FIG. 4, left-side portions of the rolling members 2531 are rotatably accommodated in the arc-shaped pit-like limiting grooves 2532, and right-side portions of the rolling members 2531 are rotatably embedded in the annular guide grooves 2533, so that the observation window 23 are rotatably abutted against the inner side of the groove wall of the installation grooves 2511 through the rolling members 2531. More preferably, the inner side and outer side of the edge of the observation window 23 are respectively provided with the annular guide groove 2533, the side walls on both sides of the installation groove 2511 are respectively provided with the limiting groove 2532, and the rolling member 2531 is embedded between the inner side of the edge of the observation window 23 and the groove wall of the installation groove 2511 on the corresponding side as well as between the outer side of the edge of the observation window 23 and the groove wall of the installation groove 2511 on the corresponding side, so that both the inner and outer sides of the edge of the observation window 23 can be movably abutted against the groove walls of the installation groove 2511 through the balls, which not only increases the flexibility of the rotation of the observation window 23, but also prevents the observation window 23 from shaking between the inner frame 22 and the outer frame 21.

Since the body of the drum washing machine will slightly vibrate when the drum washing machine is working, in order to avoid accidental rotation of the observation window 23 when the drum washing machine is working or the door assembly 2 is collided, at least one group of locking assembly 26 is further disposed between the outer frame 21 and the inner frame 22, which is configured to limit rotation of the observation window 23 in the installation grooves 2511 and to avoid accidental change of the installation orientation of the observation window 23 after rotative adjustment. Specifically, the locking assembly 26 includes a limiting post 261, a guide groove 262 disposed on an outer side of the reinforcement structure 24 in the radial direction of the observation window 23, and a capture hole disposed in the observation window 23. One end of the limiting post 261 is fixed into the guide groove 262 through an elastic member 263 (such as a spring), and the other end of the limiting post 261 is inserted into or retracted from the capture hole in a retractable manner, so as to restrict or allow rotation of the observation window 23 in the installation grooves 2511. In addition, a protruding end 264 also protrudes from the limiting post 261 in a direction perpendicular to the limiting post 261, and a slide groove 265 is formed in the reinforcement structure 24, which penetrates through the reinforcement structure 24 in an opening direction of the guide groove 262. In an assembled state, the protruding end 264 protrudes into the slide groove 265 and passes through the slide groove 265 to reach the outside of the door assembly 2.

When the user needs to adjust the installation orientation of the observation window 23 (that is, the observation window 23 is allowed to rotate), the user can hold the protruding end 264 and toggle the protruding end 264 to slide away from the observation window 23 in an opening direction of the slide groove 265. The limiting post 261 exits the capture hole and moves into the guide groove 262, and the elastic member 263 is in a compressed state. After the observation window 23 is rotated and the adjustment is completed, the protruding end 264 is released, and the elastic member 263 is changed from the compressed state to an expanded state, so that the limiting post 261 is inserted into the capture hole again when pushed by the elastic member 263 to lock the observation window 23. The position of disposing each capture hole in the observation window 23 needs to be specifically set according to the actual rotation requirement of the observation window 23 (such as the commonly used rotation angle of the observation window 23). For example, when the observation window 23 needs to be rotated by 180°, the number of the locking assemblies 26 in FIG. 3 is two and the two locking assemblies 26 are respectively disposed at positions directly above and below the observation window 23.

In summary, the drum washing machine of the present disclosure includes the door assembly 2. The door assembly 2 specifically includes the outer frame 21, the inner frame 22, and the observation window 23 disposed between the outer frame 21 and the inner frame 22, and the installation assembly 25 and the locking assembly 26 are further disposed between the outer frame 21 and the inner frame 22. The observation window 23 is rotatably sandwiched between the outer frame 21 and the inner frame 22 by means of the installation assembly 25, and the locking assembly 26 is configured to limit the rotation of the observation window 23 so that the installation orientation of the observation window 23 can be reliably maintained after the observation window 23 is rotated. With the above arrangement, the observation window 23 can be rotated separately relative to the outer frame 21 and the inner frame 22, thereby solving the problem that the user further needs to disassemble, rotate and assemble the observation window 23 when switching the door opening direction of the door assembly 2, which saves the overall operation time when the user switches the door opening direction of the door assembly 2.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A door assembly of a laundry treatment device, comprising:
- an outer frame,
- an inner frame,
- an observation window disposed between the outer frame and the inner frame, and
- an installation assembly disposed between the outer frame and the inner frame,
- wherein the installation assembly is configured to enable the observation window to be rotatably sandwiched between the outer frame and the inner frame,
- wherein the installation assembly comprises at least one fixing member disposed on an inner edge of the outer frame or an inner edge of the inner frame,
- wherein the fixing member is formed with an installation groove, and an edge of the observation window is rotatably accommodated in the installation groove, and
- wherein the installation assembly further comprises a guide assembly disposed in the installation groove, and the observation window is rotated in the installation groove by the guide assembly,
- wherein the guide assembly comprises:
- rolling members;
- limiting grooves disposed on an inner side of a groove wall of the installation groove, the rolling members being rotatably accommodated in the limiting grooves; and
- annular guide grooves disposed on the edge of the observation window, the rolling members also being capable of rolling in the annular guide grooves.

2. The door assembly of the laundry treatment device according to claim 1, wherein the rolling members are balls, and the limiting grooves are arc-shaped concave grooves disposed on the inner side of the groove wall.

3. The door assembly of the laundry treatment device according to claim 2, wherein:
- an inner side and an outer side of the edge of the observation window are respectively provided with the annular guide groove,
- the groove walls on both sides of the installation groove are respectively provided with the arc-shaped concave groove, and
- the ball is embedded between the inner side of the observation window and the groove wall on the corresponding side as well as between the outer side of the observation window and the groove wall on the corresponding side.

4. The door assembly of the laundry treatment device according to claim 1, wherein a ring-shaped reinforcement structure is fixed to the inner frame, and the fixing member is disposed on the reinforcement structure.

5. The door assembly of the laundry treatment device according to claim 4,
- wherein a locking assembly is further disposed between the outer frame and the inner frame, and
- wherein the locking assembly comprises:
- a limiting post disposed in a radial direction of the observation window;
- a guide groove disposed in the reinforcement member; and a capture hole disposed in the observation window, wherein one end of the limiting post is fixed into the guide groove in an elastic connection manner, and the other end of the limiting post is inserted into or retracted from the capture hole in a retractable manner.

6. The door assembly of the laundry treatment device according to claim 5, wherein:

the limiting post is further provided with a protruding end, the reinforcement structure is provided with a slide groove, and the protruding end is capable of protruding into the slide groove and sliding along the slide groove.

* * * * *